United States Patent [19]

Eheim

[11] 4,318,378

[45] Mar. 9, 1982

[54] REGULATOR APPARATUS FOR A FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 81,286

[22] Filed: Oct. 2, 1979

[30] Foreign Application Priority Data

Oct. 17, 1978 [DE] Fed. Rep. of Germany ..... 2845095

[51] Int. Cl.[3] ..... F02D 31/00

[52] U.S. Cl. ..... 123/357

[58] Field of Search ..... 123/449, 357, 350, 358, 123/359; 336/75, 77

[56] References Cited

U.S. PATENT DOCUMENTS

| | | | |
|---|---|---|---|
| 2,195,927 | 4/1940 | Hurst et al. | 123/357 |
| 3,661,130 | 5/1972 | Eheim | 123/358 |
| 3,841,285 | 10/1974 | Muller et al. | 123/357 |
| 3,841,286 | 10/1974 | Eheim | 123/338 |
| 3,903,852 | 9/1975 | Sola | 123/357 |
| 3,965,877 | 6/1976 | Adey | 123/357 |
| 3,970,064 | 7/1976 | Eheim et al. | 123/449 |
| 4,075,551 | 2/1978 | Zabler | 336/75 |

*Primary Examiner*—Ira S. Lazarus
*Assistant Examiner*—Magdalen Moy
*Attorney, Agent, or Firm*—Edwin E. Greigg

[57] ABSTRACT

A regulator apparatus for a fuel injection pump which includes a conventional regulator lever, together with a linear magnet which engages this lever either directly or indirectly.

8 Claims, 3 Drawing Figures

REGULATOR APPARATUS FOR A FUEL INJECTION PUMP

BACKGROUND OF THE INVENTION

The invention relates to a regulator apparatus for a fuel injection pump. This regulator apparatus contains parts which are found in mass-produced mechanical regulator devices. These known regulator apparatuses do not meet the existing demands in many internal combustion engines, in particular, if a large number of engine characteristics should be incorporated into the regulation. Here the electric/electronic regulator represents a certain optimum. Among the known electric/electronic regulators, however, a practically entirely new construction of housing and regulator parts is required, which, given the frequently low quantities of such regulators required, often results in relatively high production costs.

OBJECTS AND SUMMARY OF THE INVENTION

The regulator apparatus, in accordance with the invention, has the advantage over the prior art in that, because of the linear direction of movement produced in a solenoid, a part of the regulator can be manufactured from mass-produced parts as, for example, the regulator lever and the regulator spring as well as the pivotal displacement of the regulator lever.

Furthermore, the solenoid can be relatively favorably produced so that, in the described combination, an especially advantageous electrical regulator is provided.

The invention will be better understood as well as further objects and advantages thereof become more apparent from the ensuing detailed description of the various embodiments taken in conjunction with the drawings.

DESCRIPTION OF THE PREFERRED EMBODIMENTS

Figure 1:
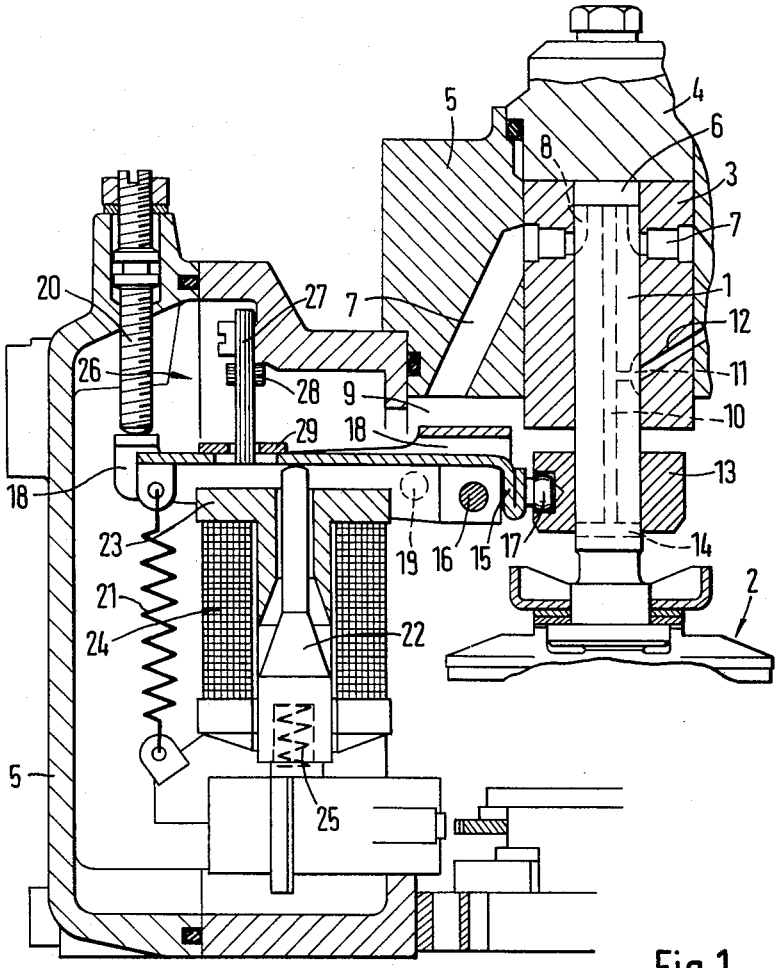
FIG. 1 is a vertical sectional view of one embodiment of the regulator of the invention.

In the embodiment of the invention illustrated in FIG. 1, a pump piston 1 of a fuel injection pump is set by a cam drive 2 into simultaneously reciprocating and rotating motion. The piston pump 1, together with a sleeve 3 and a stop 4, which are positioned in a housing 5, defines a pump work chamber 6. During the intake stroke of the pump piston 1, the pump work chamber 6 is supplied with fuel via suction channels 7 and suction grooves 8 from a suction chamber 9. During the compression stroke of the pump piston 1, fuel is delivered from the pump work chamber 6 via a bore 10 disposed in the pump piston 1 and a longitudinal distributor groove 11 into pressure channels 12, which are positioned about the distribution piston 1. The channels correspond in number to the cylinders in the internal combustion engine, each channel leading to a motor cylinder via pressure lines.

The fuel supply quantity regulation takes place via a ring slide 13 positioned around the pump piston 1, which controls a cross bore 14 of the longitudinal bore 10 of the pump piston, so that the injection begins only when the cross bore 14 is blocked during the compression stroke of the piston pump 1 via the ring slide 13. According to what position the ring slide 13 assumes, the cross bore 14 is blocked sooner or later; that is, the injected amount is larger or smaller.

The ring slide 13 is articulated via a lever 15 that is supported on a shaft 16 and is connected to the ring slide 13 by a ball 17. The shaft 16 in turn is attached to a lever 18, that is supported as indicated, at 19 in the housing, so that an adjustment of the lever 18 results in a displacement of the shaft 16. The lever 18 serves to set the position of the shaft 16 and is adjustable by a screw 20.

An armature 22 of a solenoid having a core 23 and a coil 24 engages the regulator lever 15 counter to the force of a regulator spring 21. Armature 22 and core 23 are, in part, conically shaped on the sides that are opposite one another, in order to preserve a certain linearization in the stroke and a more favorable course for the lines of force and thus also for the regulator output of the magnet. The armature 22 is furthermore loaded by a spring 25, that works counter to the force of the regulator spring 21.

Since the force of the magnet increases with decreasing distance between armature and core, while in contrast, the force of the spring 25 decreases with the increasing stroke, here also a certain linearization of the force of the magnet engaging the regulator lever 15 is attained. The stroke of the armature 22 and with that the path of the regulator lever 15 is measured by a transducer 26, in that a ferromagnetic core 27, on which an induction coil 28 is positioned, projects into a short-circuit ring 29, which is fastened on the regulator lever 15.

Figure 2:
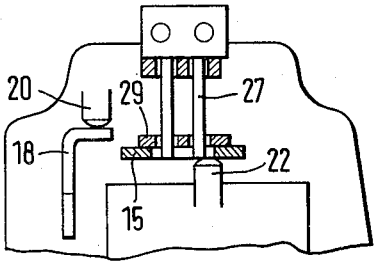
FIG. 2 is a fragmentary view, partially in section of a transducer incorporated in the regulator of FIG. 1.

As can be seen from FIG. 2, in which the area around the transducer 26 is depicted from another point of view, the core 27 is in the form of a U, and the regulator lever 15 is pierced for the purpose of receiving this core 27.

Figure 3:
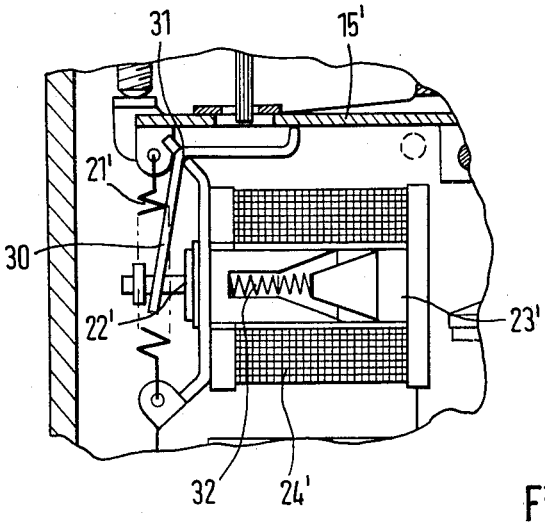
FIG. 3 is a partial view, partially in section, of a second embodiment of the invention.

The second embodiment of the invention is shown in FIG. 3, in which the magnet, in comparison to the first embodiment of FIGS. 1, 2 is installed rotated by 90°. In order to bring about the corresponding adjustment movement, here the magnet engages the regulator lever 15′ via a bell crank 30. The bell crank 30 is knife-edge supported as indicated at 31, whereupon the armature 22′, by means of the coil 24′ or the core 23′, actuates the bell crank 30 in the manner of a tie rod. A spring 32 is provided between the armature 22′ and the core 23′ which works counter to the force of the magnet, so that here, as well, a certain linearization of forces is attainable. As a result of the angular deviation of the forces, by means of the angle lever 30, a better balancing of mass can be attained.

The foregoing relates to preferred embodiments of the invention, it being understood that other embodiments and variants thereof are possible within the spirit and scope of the invention, and latter being defined by the appended claims.

What is claimed and desired to be secured by Letters Patent of the United States is:

1. A regulator apparatus for the supply quantity of a fuel injection pump for an internal combustion engine comprising a housing, a stroke piston fuel distribution pump in said housing, said pump including a pump work chamber, a reciprocating and rotatable piston, cooperating with said work chamber, an axially disposed bore in said piston extending from said work chamber, a fuel distributor groove in said piston, a radial bore in said piston extending from said axially extending bore to said fuel distribution groove, a cross bore in said piston near one end thereof, a ring slide positioned around said piston for closing and opening said cross bore for either beginning or stopping fuel delivery, a control lever supported within said housing near said ring slide, an adjusting means for limiting movement of said control lever in one direction, a regulator lever supported by said control lever for pivotable movement about one end thereof, said ring slide supported on one end of said regulator lever for movement therewith, a regulatory spring secured to the unsupported end of said regulator lever for applying a force to said regulator lever in a direction opposite from said adjusting screw, a solenoid including a coil, a core, and an armature secured within said housing in an area between said regulator spring and said supported end of said regulator lever, said armature engaging said unsupported end of said regulator lever for applying a force on said regulator lever counter to that of said regulatory spring, and a travel path transducer disposed within said housing for measuring the movement of said regulator lever.

2. A regulator apparatus in accordance with claim 1, wherein said regulator lever is provided with an opening and wherein said travel path transducer comprises a short-circuit ring positioned on said regulator lever, a transducer core mounted on said housing and at least one induction coil mounted on said transducer core, said transducer core being arranged to project through said regulator lever opening.

3. A regulator apparatus in accordance with claim 2, wherein said core is shaped in the form of a U.

4. A regulator apparatus in accordance with claim 1, wherein said armature and said solenoid are provided with complementary conical sections for the purpose of the linearization of strokes.

5. A regulator apparatus in accordance with claim 4, including a rod attached to the narrower end of said armature conical section which rod penetrates said solenoid core for direct engagement with said regulator lever.

6. A regulator apparatus in accordance with claim 1, including an intermediate lever and wherein said armature, as a pull magnet, engages said regulator lever via said intermediate lever.

7. A regulator apparatus in accordance with claim 6, including a knife-edge support and wherein said intermediate lever is in the form of a bell crank having an angle and which is supported in said angle on said knife-edge support.

8. A regulator apparatus in accordance with claim 1, including an equalization spring and wherein said armature is engaged by said equalization spring whose force works in the direction of magnetic force and decreases with increasing magnetic force.

* * * * *